US007988330B2

(12) United States Patent
Zheng

(10) Patent No.: US 7,988,330 B2
(45) Date of Patent: Aug. 2, 2011

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 289 days.

(21) Appl. No.: 12/417,604

(22) Filed: Apr. 2, 2009

(65) Prior Publication Data

US 2010/0085746 A1 Apr. 8, 2010

(30) Foreign Application Priority Data

Oct. 6, 2008 (CN) ..... 2008 1 0304744

(51) Int. Cl.
*F21V 21/00* (2006.01)

(52) U.S. Cl. ..... 362/249.02; 362/249.06

(58) Field of Classification Search ..... 362/249.02, 362/249.06
See application file for complete search history.

(56) References Cited

U.S. PATENT DOCUMENTS

2009/0290347 A1* 11/2009 Lodhie ..... 362/249.02
2011/0026253 A1* 2/2011 Gill ..... 362/249.02

* cited by examiner

*Primary Examiner* — David V Bruce
(74) *Attorney, Agent, or Firm* — Frank R. Niranjan

(57) ABSTRACT

An LED lamp includes a plurality of barrel-type holders and a plurality of LED modules mounted on an outer surface of each of the barrel-type holders. Each of the barrel-type holders has a small opening end and a large opening end opposite to the small opening end. The barrel-type holders are coaxial with each other, with a larger barrel-type holder enclosing a smaller barrel-type holder. The small opening ends of the barrel-type holders face downwardly, while the large opening ends face upwardly.

13 Claims, 6 Drawing Sheets

LED LAMP

BACKGROUND

1. Technical Field

The disclosure relates to light emitting diode (LED) lamps and, more particularly, to an LED lamp having a wide range of illumination angle.

2. Description of Related Art

The technology of LEDs has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of the heat sink to dissipate heat generated by the LEDs. Generally, the outer surface of the heat sink is planar and the LEDs are arranged on the planar outer surface to form an area light source. When the LED lamp works, the area light source formed by the LEDs mounted on the planar outer surface of the heat sink radiates light at a same direction. As a result, the LED lamp has a restricted illuminating area and the heat generated by the LEDs is relatively concentrated.

What is needed, therefore, is an LED lamp having a wide range of illumination angle to thereby function as a three-dimensional light source.

DETAILED DESCRIPTION

Figure 1:
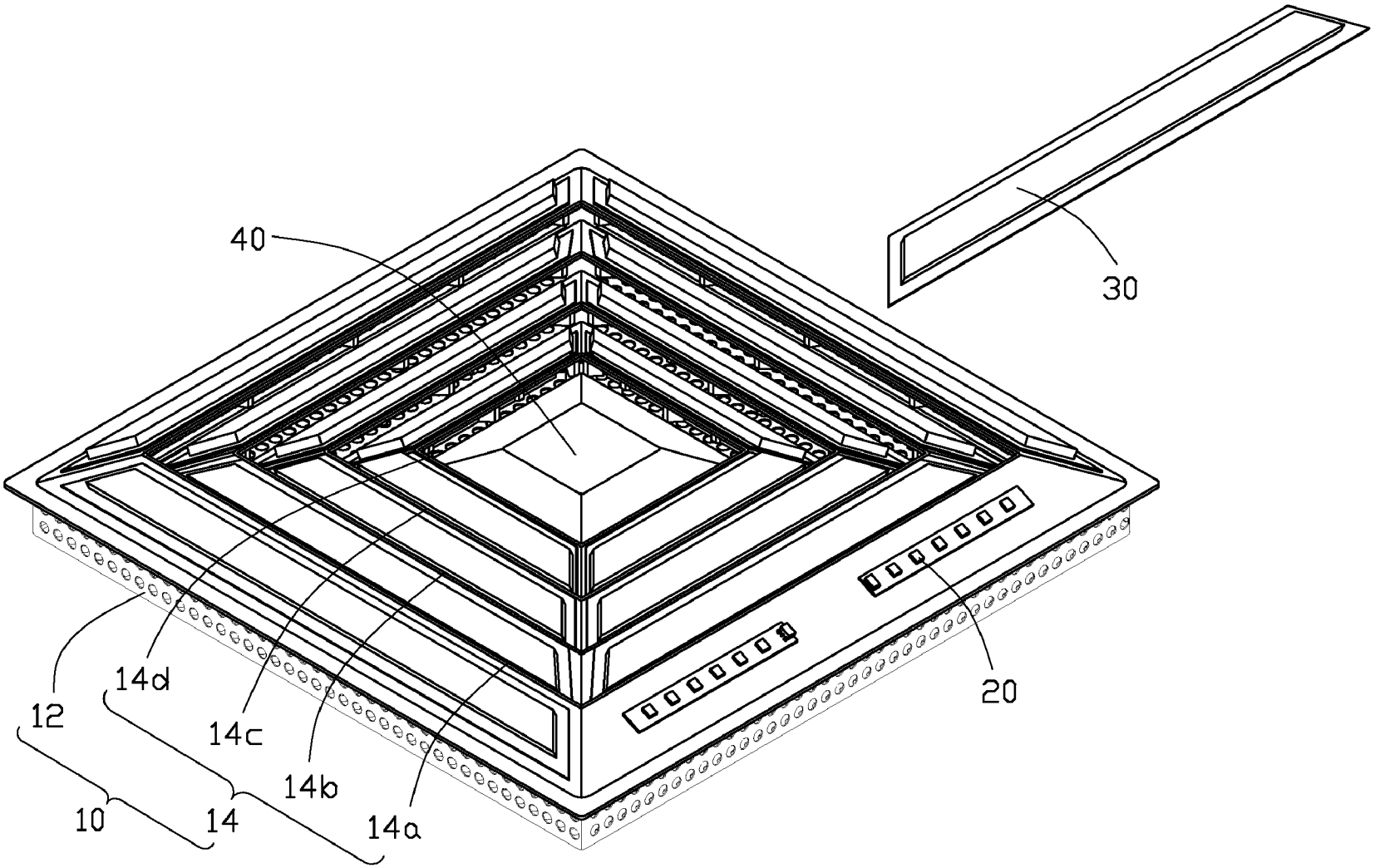
FIG. 1 is a partly exploded view of an LED lamp in accordance with an embodiment of the disclosure.
Figure 2:
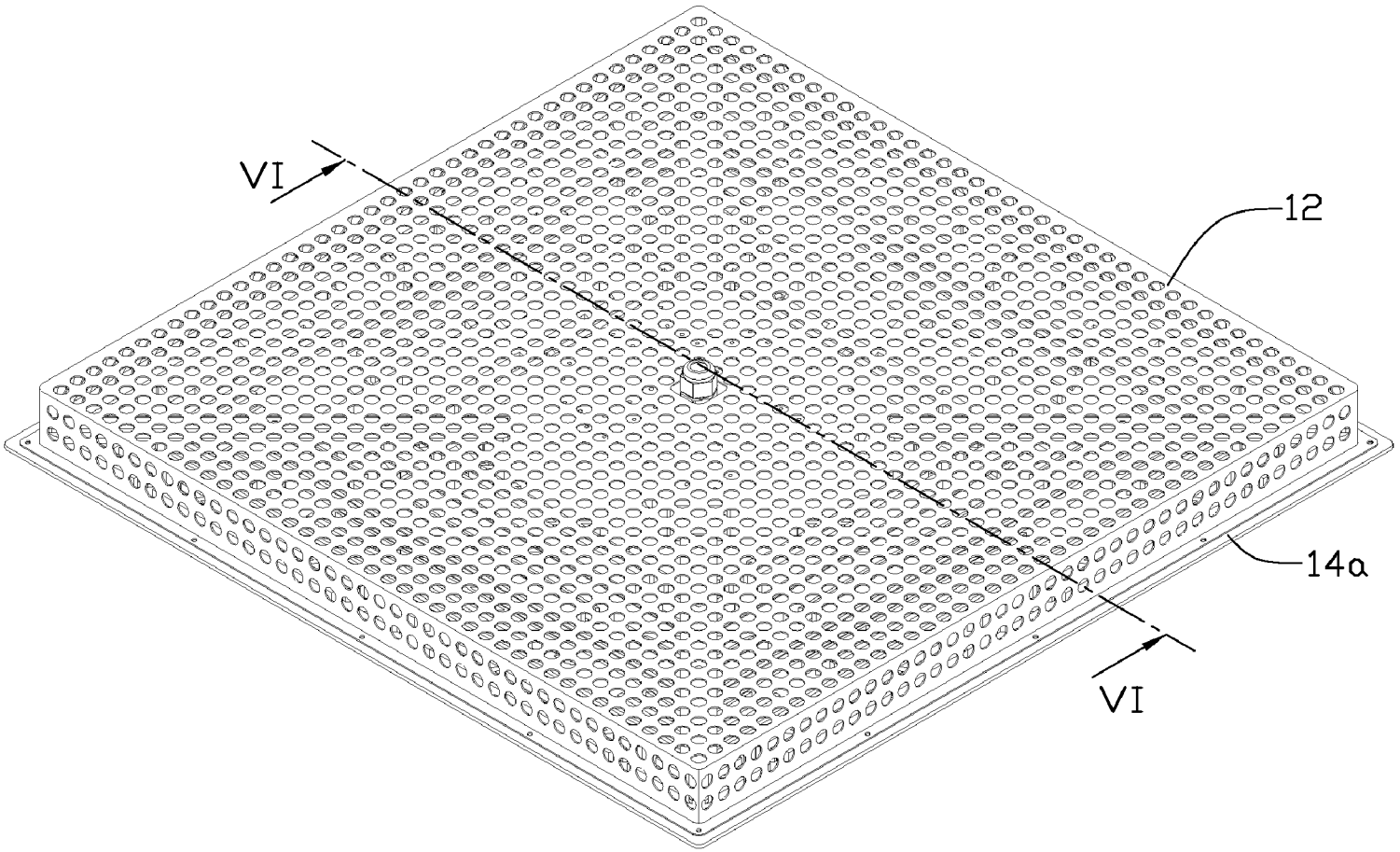
FIG. 2 is an assembled, inverted view of the LED lamp of FIG. 1.

Referring to FIGS. 1-2, an LED lamp of the disclosure comprises a bracket 10, a number of LED modules 20 mounted on the bracket 10, a number of envelopes 30 covering the LED modules 20 and mounted on the bracket 10, and a driving circuit module 40 mounted on a center of the bracket 10 and electronically connecting with the LED modules 20.

Figure 3:
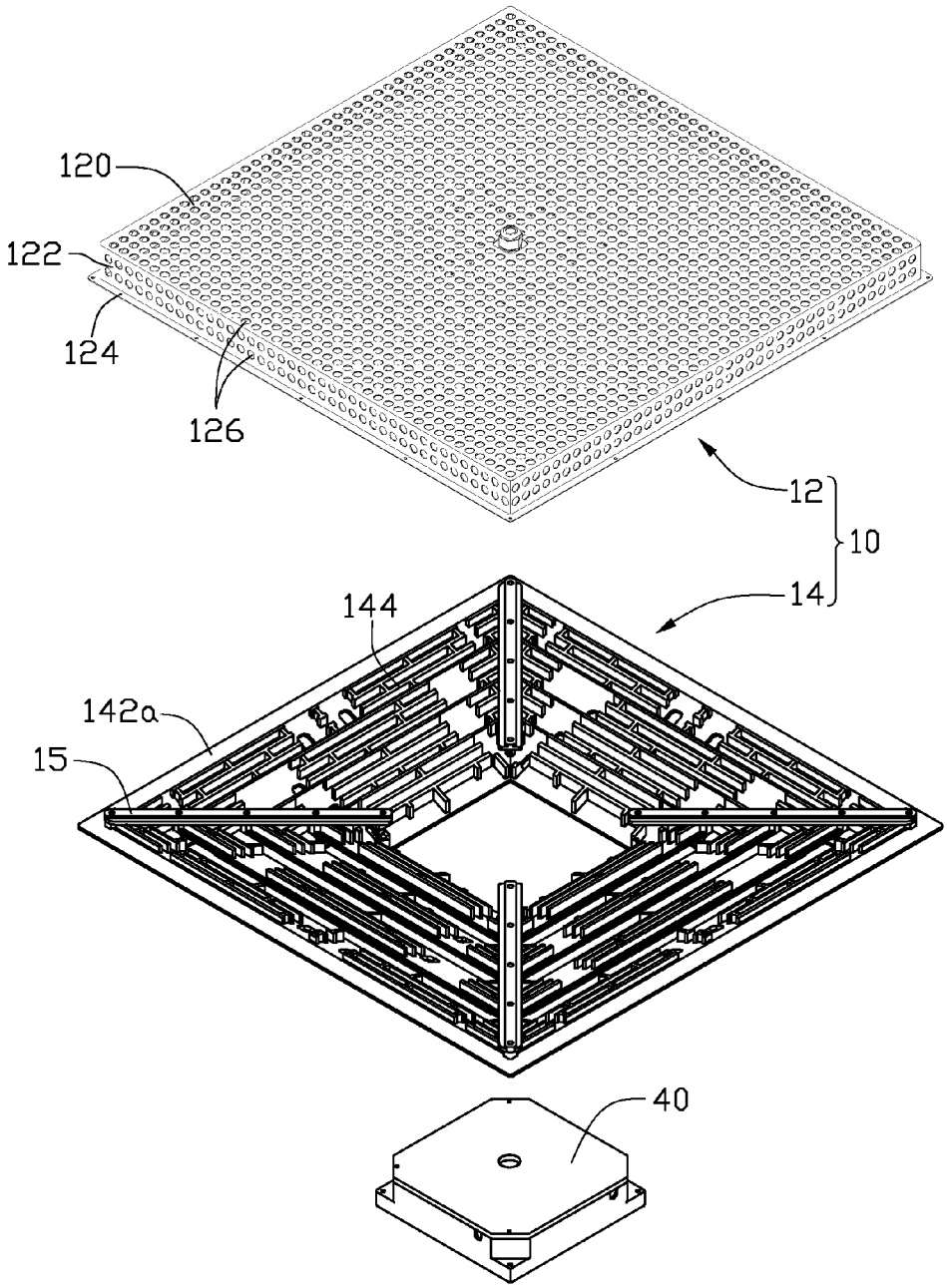
FIG. 3 is an exploded view of the LED lamp of FIG. 1.
Figure 4:
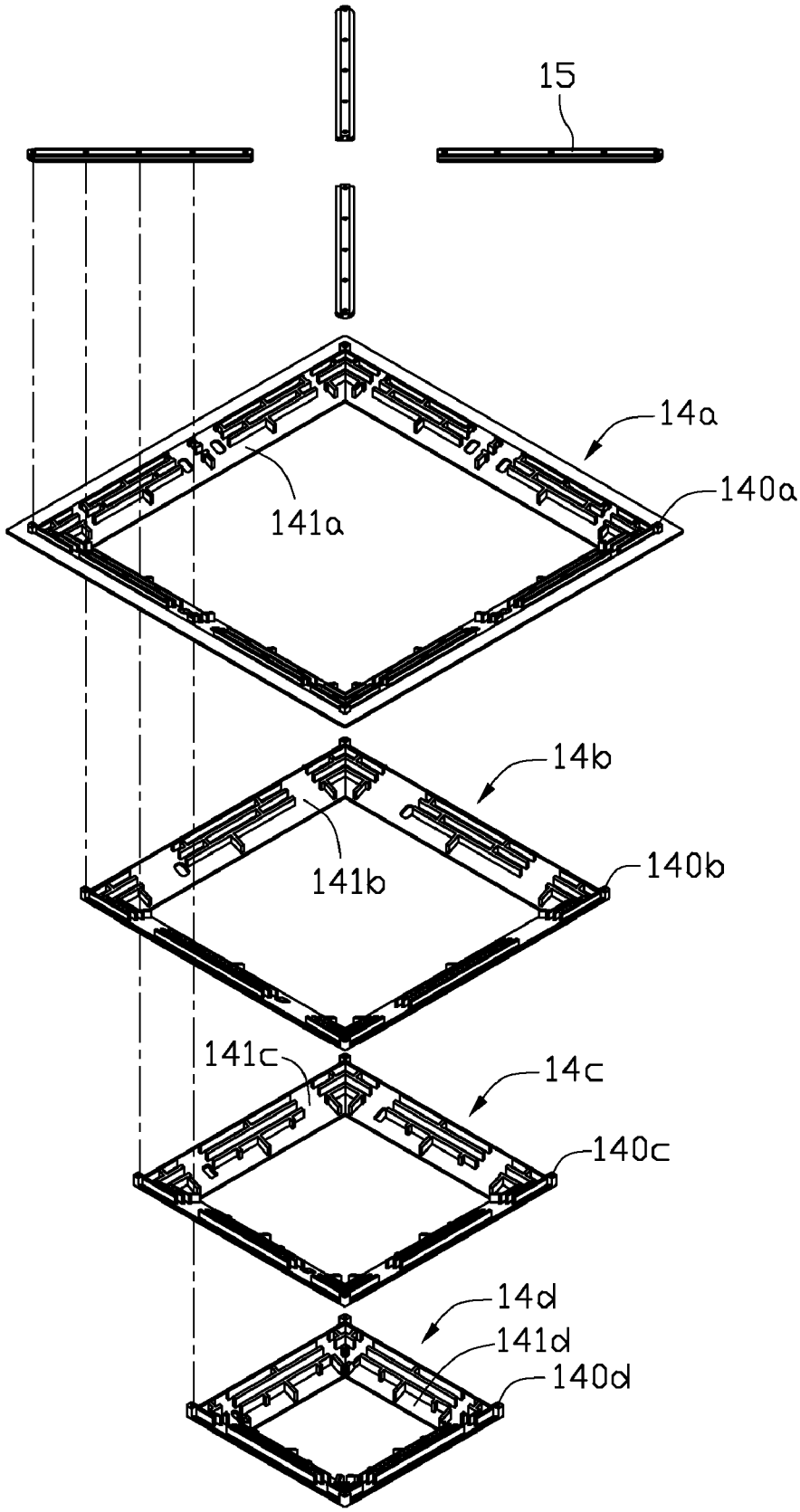
FIG. 4 is an exploded view of a bracket of the LED lamp of FIG. 3.

Referring to FIGS. 3-4 also, the bracket 10 is metallic and comprises a base 12 and a holding frame 14 mounted on the base 12. The base 12 comprises a rectangular top plate 120 and four sidewalls 122 extending downwardly from four edges of the top plate 120. A flange 124 extends outwardly from a bottom end of each of the four sidewalls 122. Each flange 124 is perpendicular to the corresponding sidewall 122. A number of through holes 126 are defined in both the top plate 120 and the sidewalls 122 of base 12 to dissipate heat of the LED lamp.

Figure 5:
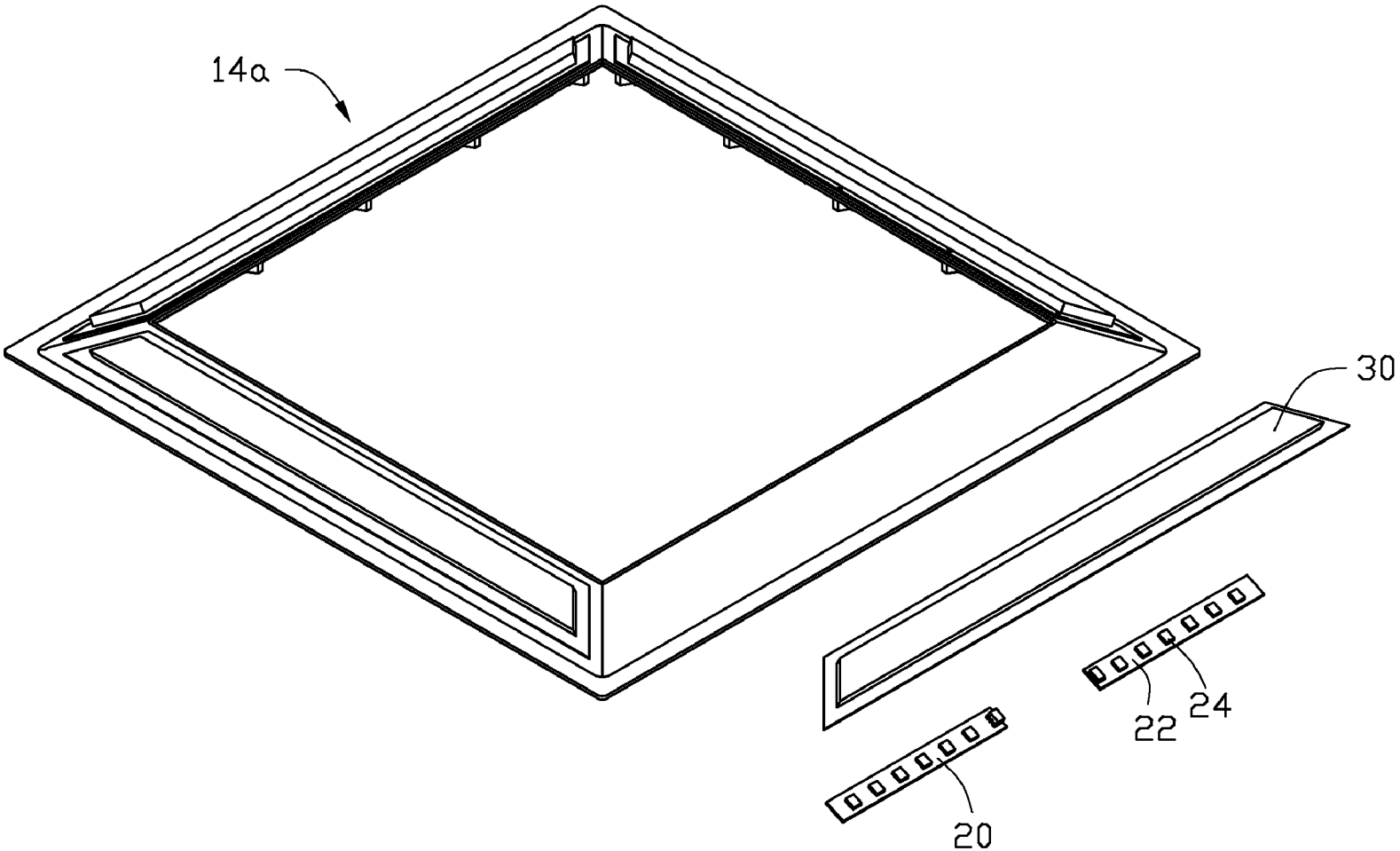
FIG. 5 is an isometric view of a holder with LED modules of the LED lamp of FIG. 1.
Figure 6:
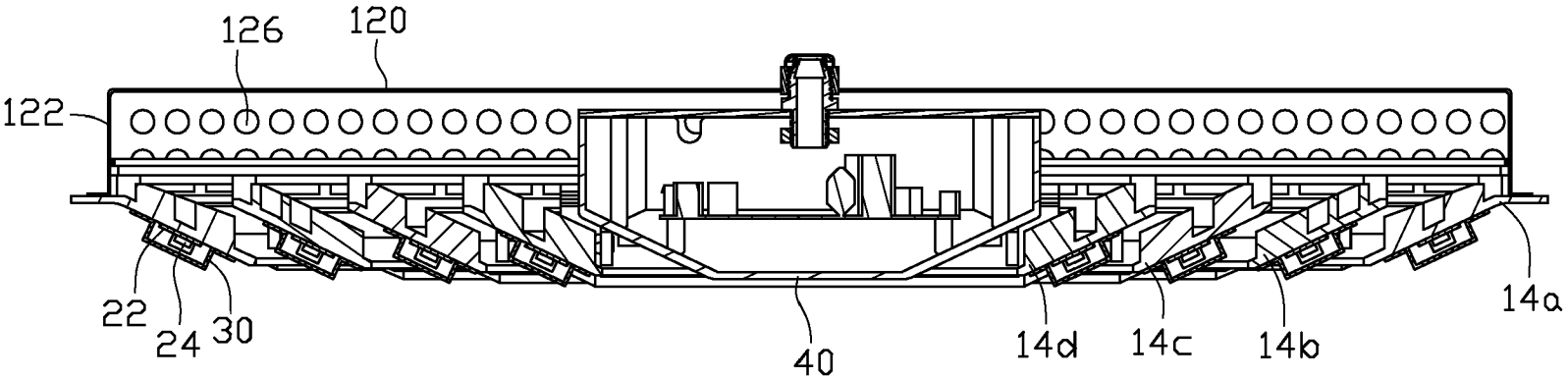
FIG. 6 is a cross-sectional view of the LED lamp of FIG. 2, taken along line VI-VI thereof.

Referring to FIGS. 5-6 also, the holding frame 14 is fixed to a bottom of the base 12. The holding frame 14 comprises a plurality of barrel-type holders with different sizes. In this embodiment, the holding frame 14 includes a first barrel-type holder 14*a*, a second barrel-type holder 14*b*, a third barrel-type holder 14*c*, and a fourth barrel-type holder 14*d*. Sizes of the first, second, third, and fourth barrel-type holders 14*a*, 14*b*, 14*c* and 14*d* are decreased in sequence.

The first, second, third, and fourth barrel-type holders 14*a*, 14*b*, 14*c* and 14*d* are coaxial and spaced from each other. The first, second, third and fourth barrel-type holders 14*a*, 14*b*, 14*c* and 14*d* each are composed of four connecting plates 141*a*, 141*b*, 141*c*, 141*d*, wherein each of the four connecting plates 141*a*, 141*b*, 141*c*, 141*d* is equicrural trapeziform. Each of the first, second, third and fourth barrel-type holders 14*a*, 14*b*, 14*c* and 14*d* has a small lower opening end and a large upper opening end opposite to the small lower opening end, as better seen from FIG. 6. The barrel-type holder 14*a* encloses the barrel-type holders 14*b*, 14*c* and 14*d* therein; the barrel-type holder 14*b* encloses the barrel-type holders 14*c* and 14*d* therein; the barrel-type holder 14*c* encloses the barrel-type holder 14*d* therein. Heights of the first, second, third, and fourth barrel-type holders 14*a*, 14*b*, 14*c*, 14*d* are equal to each other. Areas enclosed by of the first, second, third, and fourth barrel-type holders 14*a*, 14*b*, 14*c* and 14*d* are decreased in sequence.

The first barrel-type holder 14*a* is located at a fringe of the base 12. Four flanges 142*a* extend outwardly from the large upper opening end of the first barrel-type holder 14*a*. The flanges 142*a* are attached to the flanges 124 of the base 12 and have outer ends located beyond outer ends of the flanges 124 (better seen in FIG. 6). The fourth barrel-type holder 14*d* is located at a central portion of the base 12. The third barrel-type holder 14*c* encloses the fourth barrel-type holder 14*d* therein. The second barrel-type holder 14*b* encloses the third barrel-type holder 14*c* therein.

Each of the connecting plates 141*a*, 141*b*, 141*c*, 141*d* of the first, second, third, and fourth barrel-type holders 14*a*, 14*b*, 14*c*, 14*d* has an inclined upper first surface oriented towards the base 12 and an inclined lower second surface opposite to the first surface. A number of fins 144 are formed on the first surfaces of the connecting plates 141*a*, 141*b*, 141*c*, 141*d* to dissipate heat of the LED lamp. Each corner of the first surface of each of the four barrel-type holders 14*a*, 14*b*, 14*c*, 14*d* forms an engaging portion 140*a*, 140*b*, 140*c*, 140*d*.

Four elongated connecting members 15 are so located that each extends over four corresponding corners of the four barrel-type holders 14*a*, 14*b*, 14*c*, 14*d* of the holding frame 14. The connecting members 15 connect with the engaging portions 140*a*, 140*b*, 140*c*, 140*d* to assemble the first, second, third, and fourth barrel-type holders 14*a*, 14*b*, 14*c*, 14*d* together. The connecting members 15 are coplanar and have inner ends secured to the driving circuit module 40 which in turn is secured to the top plate 120 of the base 12 via a fixture (not labeled) to thereby assemble the barrel-type holding frame 14 to the base 12 of the bracket 10. The driving circuit module 40 is enclosed by the fourth barrel-type holder 14*d*. When the barrel-type holding frame 14 is mounted on the base 12, the corresponding connecting plates 141*a*, 141*b*, 141*c*, 141*d* are parallel to and spaced from each other. The horizontal top plate 120 of the base 12 and the connecting plates 141*a*, 141*b*, 141*c*, 141*d* form an angle of about 30°-60° therebetween. The LED modules 20 are mounted on the inclined lower second surfaces of the connecting plates 141*a*, 141*b*, 141*c*, 141*d*.

Each of the LED modules 20 comprises a printed circuit board 22 and a number of LEDs 24 mounted on the printed circuit board 22. A trapaziform envelope 30 is mounted on the connecting plate and covers the LED module 20. The LED modules 20 are mounted on the inclined lower second surfaces of the connecting plates 141*a*, 141*b*, 141*c*, 141*d* and oriented towards four different directions. By such design, a large illumination angle can be obtained.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a plurality of barrel-type holders, each of the barrel-type holders having a small opening end and a large opening end opposite to the small opening end, the small opening ends being level with each other, the large opening ends being level with each other, the plurality of barrel-type holders being coaxially arranged with an larger barrel-type holder enclosing a smaller barrel-type holder;

a plurality of LED modules mounted on an outer surface of each of the barrel-type holders.

2. The LED lamp as claimed in claim 1, wherein each of the barrel-type holders comprises four connecting plates connecting with each other and forming four sides of the each barrel-type holder, and the LED modules are mounted on outer surfaces of the connecting plates.

3. The LED lamp as claimed in claim 2, wherein the connecting plates of the barrel-type holders at a corresponding side are spaced from and parallel to each other.

4. The LED lamp as claimed in claim 3, wherein heights of the barrel-type holders are equal to each other.

5. The LED lamp as claimed in claim 4, wherein a metallic base is mounted on the barrel-type holders and adjacent to the large open ends of the barrel-type holders.

6. The LED lamp as claimed in claim 5, wherein a plurality of through holes are defined in the base.

7. The LED lamp as claimed in claim 2, wherein inner surfaces of the connecting plates of the barrel-type holders form a plurality of fins.

8. The LED lamp as claimed in claim 1, wherein a driving circuit module is enclosed by an innermost one of the barrel-type holders and electronically connects with the LED modules.

9. An LED lamp comprising:

a metallic bracket comprising a base and a mounting member mounted on a bottom of the base, the mounting member comprising a first holder and a second holder, the second holder enclosing the first holder therein and spaced from the first holder, each of the first and second holders comprising a plurality of connecting plates which are oriented towards different directions, respectively; and a plurality of LED modules being mounted on outer surfaces of the connecting plates of each of the first and second holders.

10. The LED lamp as claimed in claim 9, wherein each of the first and second holders has a small opening end and a large open end, and the large open end is adjacent to the base.

11. The LED lamp as claimed in claim 9, wherein each of the first and second holders comprises four trapeziform connecting plates oriented towards four different directions, corresponding connecting plates of the first and second holders which are oriented towards one of the directions are parallel to each other.

12. The LED lamp as claimed in claim 9, wherein the corresponding connecting plates of the first and second holders form an inclined angle of 30°-60° relative to a horizontal plane.

13. The LED lamp as claimed in claim 9, wherein the first and second holders are coaxial with each other.

* * * * *